US010232207B1

(12) United States Patent
Louis

(10) Patent No.: US 10,232,207 B1
(45) Date of Patent: Mar. 19, 2019

(54) REBOUND TRAINING DEVICE

(76) Inventor: John G. Louis, Northfield, IL (US)

( * ) Notice: Subject to any disclaimer, the term of this patent is extended or adjusted under 35 U.S.C. 154(b) by 394 days.

(21) Appl. No.: 13/602,087

(22) Filed: Aug. 31, 2012

Related U.S. Application Data

(60) Provisional application No. 61/530,942, filed on Sep. 3, 2011.

(51) Int. Cl.
*A63B 5/11* (2006.01)

(52) U.S. Cl.
CPC ..... *A63B 5/11* (2013.01)

(58) Field of Classification Search
CPC .... A63B 5/00; A63B 5/06; A63B 5/11; A63B 5/12; A63B 5/16
USPC ..... 482/27–29
See application file for complete search history.

(56) References Cited

U.S. PATENT DOCUMENTS 16,942 A * 3/1857 Wellman ..... A47C 7/62 248/604
2,860,689 A * 11/1958 Baker ..... A47D 13/105 297/273
3,047,294 A 7/1962 Maxwell
4,474,369 A * 10/1984 Gordon ..... A63B 69/0035 472/92
4,787,630 A 11/1988 Watson et al.
4,836,530 A 6/1989 Stanley, Jr.
5,499,949 A * 3/1996 Heubl ..... A47D 13/107 297/274
5,674,157 A 10/1997 Wilkinson
5,690,383 A * 11/1997 Meeker ..... 297/274
5,816,983 A * 10/1998 Dawes ..... A47C 3/0255 482/130
5,876,311 A 3/1999 Coates et al.
6,135,922 A * 10/2000 Nissen ..... 482/27
6,599,198 B2 * 7/2003 Ettenhofer ..... A63B 69/04 434/247
6,942,487 B2 * 9/2005 Corbalis ..... A63B 69/0093 280/818
7,094,181 B2 8/2006 Hall
7,666,126 B2 * 2/2010 Rempe ..... A63B 22/18 482/121
D694,349 S * 11/2013 Chen ..... D21/686
2005/0043142 A1 2/2005 Rieber
2006/0079378 A1 * 4/2006 Ader ..... A63B 5/16 482/26
2008/0076638 A1 3/2008 Publicover

* cited by examiner

*Primary Examiner* — Loan H Thanh
*Assistant Examiner* — Rae Fischer
(74) *Attorney, Agent, or Firm* — John C. Shepard

(57) ABSTRACT

A rebound training device includes a frame, a footboard, and a plurality of resilient elements extending between and attached to the frame and the footboard to support the footboard above a supporting surface. A user standing on the footboard manually effects repeated vertical bouncing movement between upper and lower positions. The distance traveled by the footboard, the effort required to effect movement, and the stability thereof may be modified by selectively modifying the number, the length, the position, or the elasticity of the resilient members.

16 Claims, 5 Drawing Sheets

REBOUND TRAINING DEVICE

CROSS-REFERENCE TO RELATED APPLICATIONS

This application claims the benefit of Provisional Patent Application Ser. No. 61/530,942, filed Sep. 3, 2011.

DESCRIPTION

Background of the Invention

Technical Field

The present invention pertains to exercise apparatus and, more particularly, to a rebound training device with a footboard resiliently attached to a supporting frame.

Background Art

It is generally accepted that exercise is beneficial in maintaining a healthy body. Two general types of exercise are anaerobic and aerobic and both should be included in a balanced exercise program. Anaerobic exercise involves low-level muscle exertion over short periods of time and includes, for example, strength training and short-distance running. Aerobic (or cardiovascular) exercise involves higher levels of muscle exertion over a longer period of time to work the heart, lungs and blood vessels and includes, for example, long-distance running, jogging, walking, aerobic dancing, jumping rope, swimming, bicycling, basketball and tennis.

Exercise devices for assisting users in aerobic exercise include treadmills, stair climbers, stationary bicycles, elliptical trainers, rowers, trampolines, and the like. Aerobic exercise may also classified as low impact or high impact. Some of the aforementions exercise devices provide low impact exercise and some high impact exercise. Intensive high impact aerobic exercise may increase endurance, muscle strength, bone growth, and cardiovascular health. However, high impact exercise may not be appropriate for individuals who are older or disabled and must adopt less strenous or low-impact forms of aerobic exercise.

Rebounding has been developed to provide therapeutic movement, exercise and recreation for individuals with special needs. Typically, a small trampoline or mini-trampoline is used as a rebounding training device. Bouncing or jumping on a trampoline provides aerobic exercise. Besides the usual benefits associated with aerobic exercise, such as muscle development and calorie burning, it is also believed that rebounding is beneficial for the lymph system in the human body.

It is noted that the use of a trampoline often means that there are no handholds for balance and that the user's feet often leave the flexible spring surface. When the user lands, there is a jarring effect on the feet, angles, shins, knees, and lower back. Also, there is the possibility that the user may land awdwardly on the trampoline's flexible surface, so that he might twist those same parts and cause injury.

While all of the prior art devices are sufficient for their intended function, other constructions for exercise devices may provide features that are more desirable to a user.

BRIEF SUMMARY OF THE INVENTION

The present invention is directed to overcoming one or more of the problems as set forth above.

It is an object of the present invention to provide a rebound training device maximizing a user's level of aerobic exercise and minimizing the effects of impact on the user.

It is another object of the present invention to provide a rebound training device wherein the amount of vertical travel may be modified to increase or decrease the intensity of physical exertion during a workout.

It is a further object of the present invention to provide a rebound training device wherein the user is able to maintain his balance when rocking or swaying may be adjusted.

In accordance with the present invention, a rebound training device includes a frame with a lower portion adapted to rest on a floor and an upper portion disposed thereabove, a footboard adapted to support a user standing thereon, and a plurality of resilient elements extending between the frame and the footboard to suspend the footboard below the frame upper portion above the floor.

In one aspect of the invention, the resilient elements are detachably secured to the frame and the footboard so that the number and elastic capacity of the resilient elements may be modified.

In another aspect of the invention, the footboard includes connecting means adjacent the lateral edges thereof to couple with connecting means on respective ends of the resilient elements to join the footboard to the resilient elements.

In a further aspect of the invention, the footboard includes an array of holes adjacent the lateral edges thereof adapted to receive connectors on the respective ends of the resilient elements.

In yet another aspect of the invention, the frame includes gripping portions adapted to grasped by a user to assist in applying bounce force and allow the user to balance himself on the moving footboard.

In another aspect of the invention, a frame is provided that is relatively compact minimizing its footprint with its height and width enabling the resilient elements to be directed downward and inward to the footboard and enabling vertical to a range allowing the user to maintain his grip on the frame gripping portion during vertical travel.

In another aspect of the invention, hand grips are provided that can be adjusted relative to vertical for the desired comfort of the user depending on the user's height, bounce height range, and other positions and movement achieved by the user.

In another aspect of the invention, the hand grips are configured as ski-pole-type handlebars.

In another aspect of the invention, the footboard is relatively large for increased stability.

In another aspect of the invention, a rectangular footboard may be rotated to change its X-axis orientation and thereby modify forward/rearward and side-to-side stability.

In another aspect of the invention, the frame is constructed with rigid tubular members that can be manufactured in a disassembled state and reassembled for use.

BRIEF DESCRIPTION OF THE SEVERAL VIEWS OF THE DRAWINGS

The details of construction and operation of the invention are more fully described with reference to the accompanying drawings which form a part hereof and in which like reference numerals refer to like parts throughout.

In the drawings.

Figure 3:
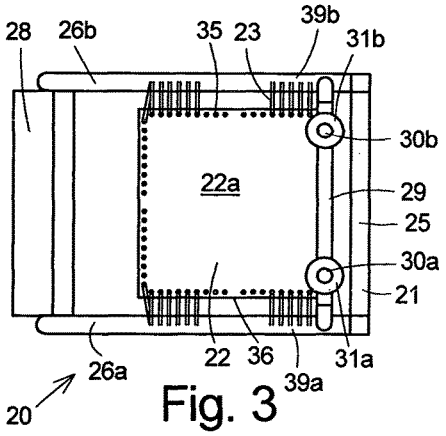
FIG. 3 is a top plan view of the rebound training device shown in FIG. 1.
Figure 4:
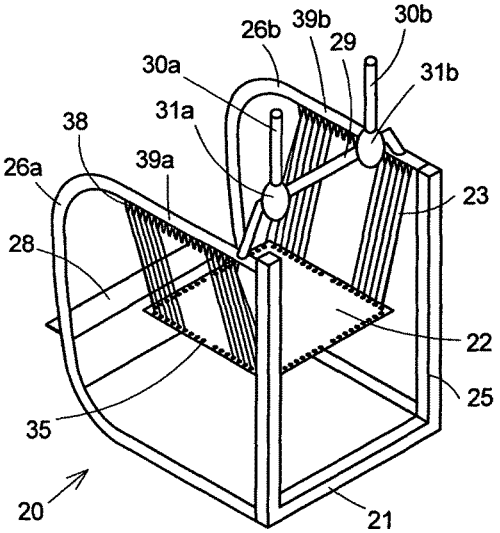
FIG. 4 is an isometric view of the rebound training device shown in FIG. 1.
Figure 2:
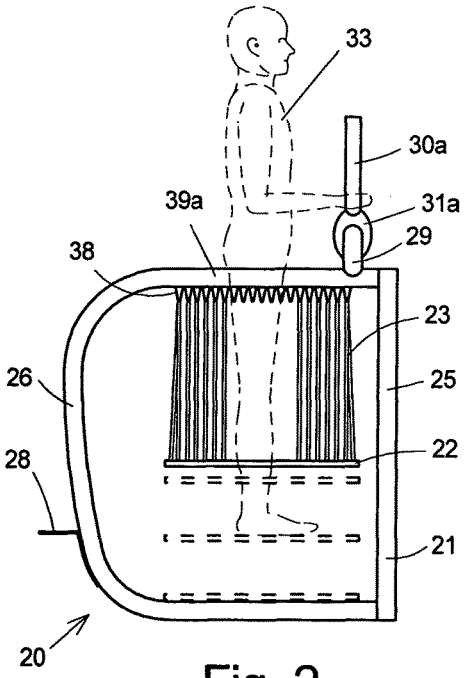
FIG. 2 is a side elevational view of the rebound training device shown in FIG. 1.
Figure 1:
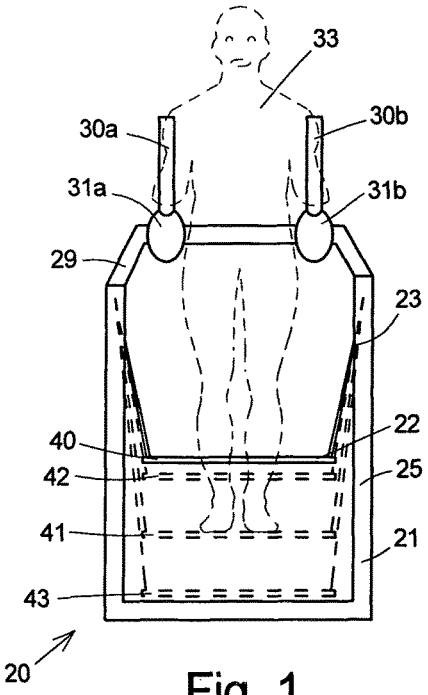
FIG. 1 is a front elevational view of a rebound training device embodying the principles of the invention.
Figure 7:
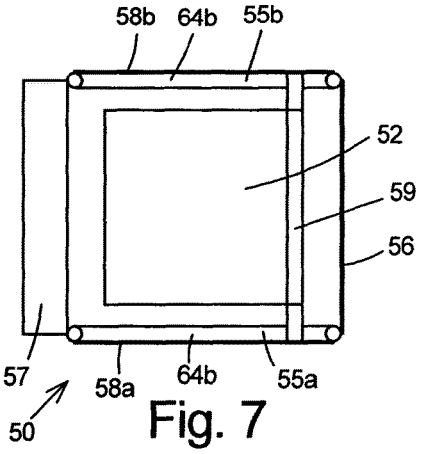
FIG. 7 is a top plan view of the rebound training device shown in FIG. 5.
Figure 8:
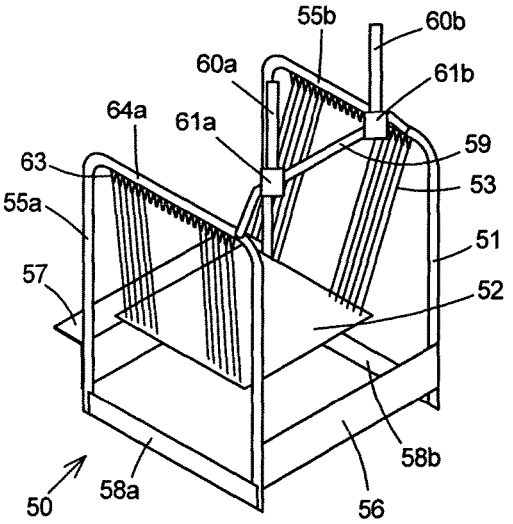
FIG. 8 is an isometric view of the rebound training device shown in FIG. 5.
Figure 6:
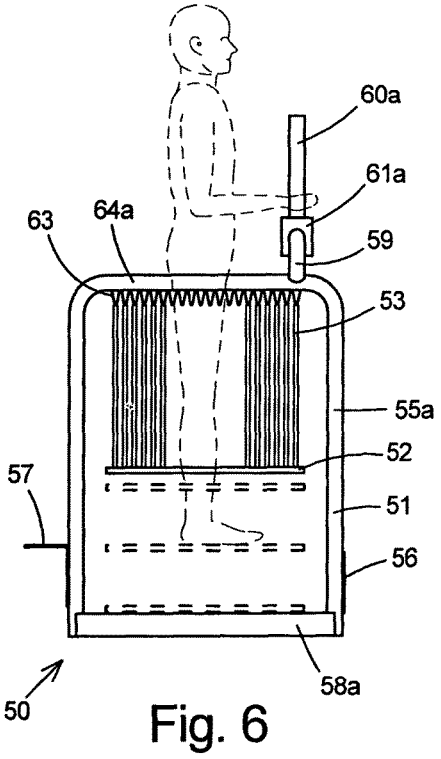
FIG. 6 is a side elevational view of the rebound training device shown in FIG. 5.
Figure 5:
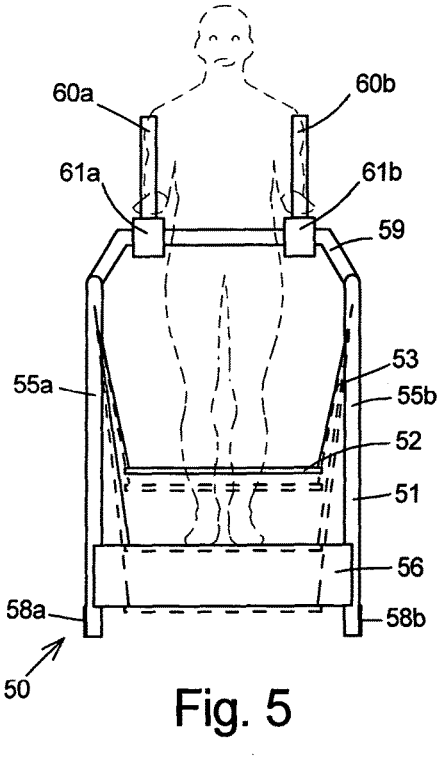
FIG. 5 is a front elevational view of a second rebound training device embodying the principles of the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood.

DETAILED DESCRIPTION OF THE PREFERRED EMBODIMENTS

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Referring to the drawings in greater detail, and more particularly to FIGS. 1-4, a rebound training device, generally designated 20, is seen to include a stationary open frame structure, generally designated 21, a movable platform or footboard 22, and a plurality of resilient elements, collectively designated 23, suspending the footboard 22 from the frame structure 21 and positioning the footboard 22 above a supporting surface (not shown).

For the purposes of description and to aid in the understanding of the invention disclosed herein, a longitudinal X-axis extends from front to back, a lateral Y-axis extends from side to side, and a vertical Z-axis extends from top to bottom. Longitudinal translational motion is referred to as surge and rotation about an axis parallel to the X-axis is referred to as roll. Lateral translational motion is referred to as sway and rotation about an axis parallel to the Y-axis is referred to as pitch or rock. Vertical translational motion is referred to as heave or bounce and rotation about an axis parallel to the Z-axis is referred to as yaw or twist. As will be readily understood that while a user will primarily use the training device to effect up and down bouncing of himself on the footboard, the user by exerting appropriate force to the footboard may cause the footboard to move or rotate in any of the aforementioned directions. It should also be understood that parts on one lateral side of the training device have similar corresponding parts on the opposite side of the training device.

The open frame structure 21 includes a U-shaped, tubular front frame 25, a pair of C-shaped, tubular, side frames 26*a* and 26*b*, an L-shaped rear step-brace 28, and an angular, tubular cross member 29. Attached to the cross member 29, which rises above the side frames 26*a* and 26*b*, are a pair of upright handlebars 30*a* and 30*b* secured to the round cross member 29 by clamps 31*a* and 31*b* allowing horizontal adjustment of the spacing between the handlebars 30*a* and 30*b* and their angle relative to the frame 25. The upper and lower forward edges of the side frames 26*a* and 26*b*, which are formed of round tube, are fixed to the rear surface of the front frame 25. The step-brace 28 formed of a bent plate and the angular cross member 29 formed of round tube extend between the side frames 26*a* and 26*b* and provide structural support. The frame structure 21 is constructed of 2.5-inch square tube and 2.5-inch round tube using steel, aluminum, carbon fiber, wood, or other suitable materials. It is contemplated that the frame may be constructed so as to be disassembled and reassembled as necessary. The frame structure 21, excluding the cross member, handlebars and step, is approximately 36 inches wide, 45 inches long and 48 inches high.

The footboard 22 has an upper surface 22*a* upon which a user 33 (shown in phantom) places his feet measures approximately 26 inches by 24 inches and has an array of spaced holes, collectively designated 35, extending along and adjacent its peripheral edges 36, but may be constructed in other sizes depending on the stability desired or a user's stance. The footboard 22 is of a material sufficiently rigid to support a user standing thereon, such as plastic, wood, metal or the like.

The resilient elements 23 have a first end attached to the frame structure 21, a second end attached to the footboard 22, and a length. The resilient elements 23 extend from the frame structure 21 downwardly and inwardly to the peripheral edges of the footboard 22. The resilient elements 23 may be rubber straps, elastic bands, bungees, springs, or the like, that enable the footboard 22 to be reciprocally moved up and down vertically relative to the frame 21. The number of resilient elements 23 employed and their elasticity is selected to provide an appropriate range of vertical movement. Unloaded, the footboard 22 rests at an upper position indicated at 40. When a user 33 steps onto the footboard 22, the footboard 22 is caused to move to a middle position shown in phantom at 41. As the user 33 bounces in trampoline fashion, the footboard 22 will move between an upper position shown in phantom at 42 and a lower position shown in phantom at 43, which are approximately 8 inches above and below the middle position 41. Movement of the user 33 may also effect greater vertical motion as well as controlled horizontal translation and rotational motion of the footboard 22.

It is understood that the resilient elements 23 are selected to locate the footboard in a vertical position wherein downward travel is limited to a height slightly above the supporting floor surface and upward travel is limited to a height that enables the user to maintain a grip on the handlebars or other gripping areas.

Placement of the resilient elements 23 is adjustable along zig zag wire hangers 38 secured to the underside of the top elements 39*a* and 39*b* of respective C-frames 26*a* and 26*b* and the spaced holes 35 along the footboard periphery. It is understood that the horizontal placement of the resilient elements 23 along the wire hangers and the footboard regulate the stability of the footboard, particularly its pitch or sway. It is also understood that it is possible to construct the device using many types of releasable connectors, including hooks, rings, eyelets, bolts, screws, or the like.

In FIGS. 4-8, a second embodiment of a rebound training device, generally designated 50, is seen to include a frame structure, generally designated 51, a footboard 52, and a plurality of resilient elements, collectively designated 53, suspending the footboard 52 from the frame structure 51. Herein, the frame structure 51 includes a pair of spaced, inverted, U-shaped, tubular side frames 55*a* and 55*b*, a front brace plate 56, an L-shaped rear step-brace 57 extending between the side frames 55*a* and 55*b*, a pair of lower side brace plates 58*a* and 58*b*, and a tubular cross member 59. Attached to the angular cross member 59, which rises above the side frames 55*a* and 55*b*, are a pair of upright handlebars 60*a* and 60*b* secured to the round cross member 59 by clamps 61*a* and 61*b* allowing horizontal adjustment of the spacing between the handlebars 60*a* and 60*b* and the vertical angle thereof. Herein, the frame components are formed from 2-inch round tube and brace elements from flat plate. The frame structure 51, excluding the cross member, handlebars and step, is approximately 36 inches wide, 36 inches long and 48 inches high.

Similar to the rebound training device shown in FIGS. 1-4, the resilient elements 53 extend between zig zag wire hangers 63 fixed to the underside of the top elements 64 of the frame 51 and arrayed holes (not shown) adjacent the peripheral edges of the footboard 52.

Figure 11:
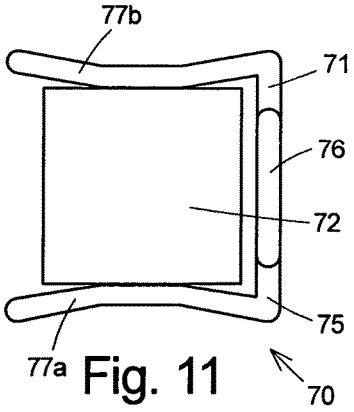
FIG. 11 is a top plan view of the rebound training device shown in FIG. 9.
Figure 10:
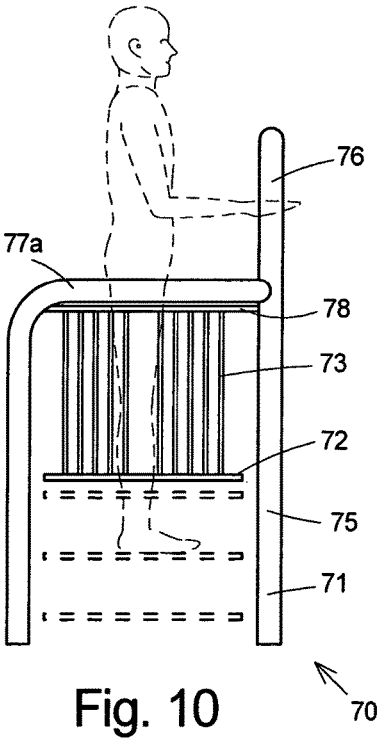
FIG. 10 is a side elevational view of the rebound training device shown in FIG. 9.
Figure 9:
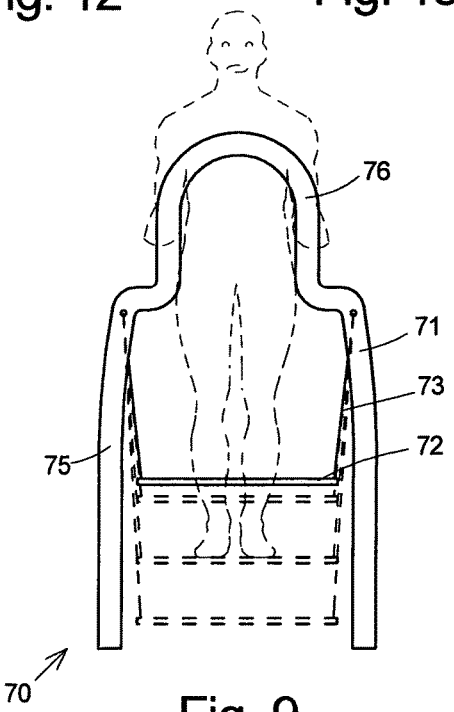
FIG. 9 is a front elevational view of a third rebound training device embodying the principles of the invention.

In FIGS. 9-11, a third embodiment of a rebound training device, generally designated 70, is seen to include a frame structure, generally designated 71, a footboard 72, and a plurality of resilient elements, collectively designated 73, suspending the footboard 72 from the frame structure 71. Herein, the frame structure 71 includes an inverted, generally U-shaped, tubular front frame 75 with an upper, grippable, narrow portion 76, and a pair of spaced, inverted, L-shaped, tubular side frames 77*a* and 77*b* having their forward ends fixed to the rear surface of the front frame 75. The side frames 77*a* and 77*b* converge inwardly along their upper portions to provide gripping areas in the center thereof for the user. Herein, the frame components are formed from 2.5-inch round tube. The frame structure 71, excluding the cross member, handlebars and step, is approximately 36 inches wide, 36 inches long and 68 inches high.

Similar to the footboard shown in FIG. 3, the footboard 72 has an array of peripheral holes (not shown) enabling the lower ends of the respective resilient elements 73 to be attached to the footboard 72. The upper ends of the respective resilient elements 73 are attached to horizontal hanger bars 78 mounted to the frame 71 below the top portions of the side frames 771 and 77*b*.

Figure 12:
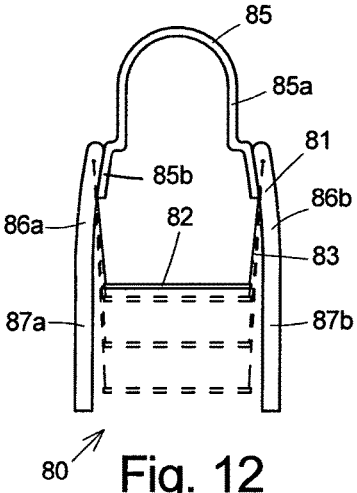
FIG. 12 is a front elevational view of a fourth rebound training device embodying the principles of the invention.
Figure 13:
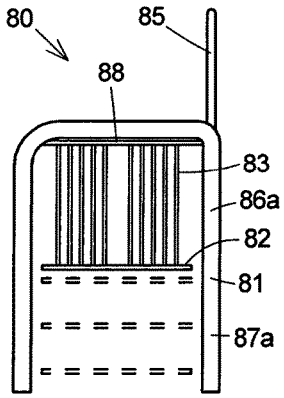
FIG. 13 is a side elevational view of the rebound training device shown in FIG. 12.

In FIGS. 12 and 13, a fourth embodiment of a rebound training device, generally designated 80, is seen to include a frame structure, generally designated 81, a footboard 82, and a plurality of resilient elements, collectively designated 83, suspending the footboard 82 from the frame structure 81. Herein, the frame structure 81 includes an inverted U-shaped, tubular front frame 85, which provides upright gripping sections 85*a* and lower spaced attaching sections 85*b*, and a pair of spaced, inverted, U-shaped, tubular side frames 86*a* and 86*b*. The front frame 85 extends between the side frames 86*a* and 86*b* and is secured on the downwardly extending forward portions 87*a* and 87*b* of the side frames 86*a* and 86*b*. The resilient elements 83 extend between horizontal hanger bar 88 and the footboard 82. Herein, the side frames 86*a* and 86*b* are formed from 3-inch round tube and the front frame 85 is formed from 1.5-inch round tube. The frame structure 81, excluding the cross member, handlebars and step, is approximately 36 inches wide, 36 inches long and 68 inches high.

Figure 16:
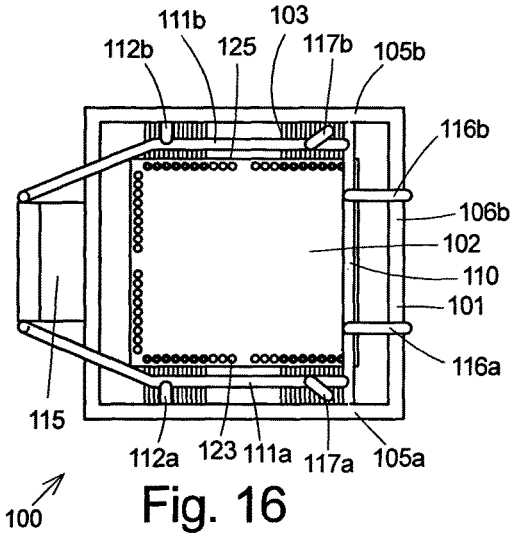
FIG. 16 is a top plan view of the rebound training device shown in FIG. 14.
Figure 15:
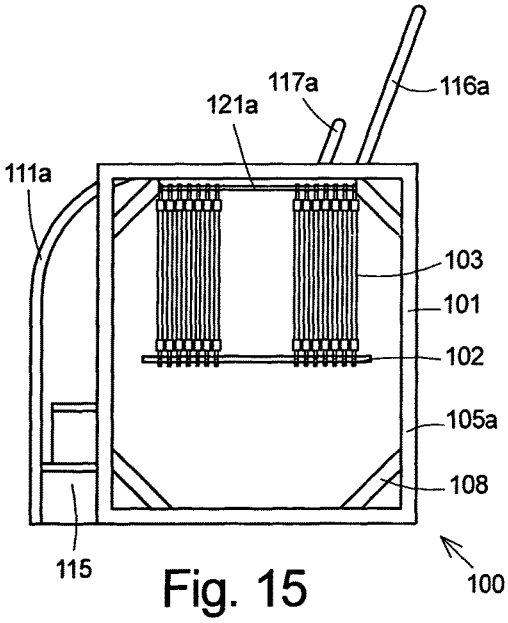
FIG. 15 is a side elevational view of the rebound training device shown in FIG. 14.
Figure 14:
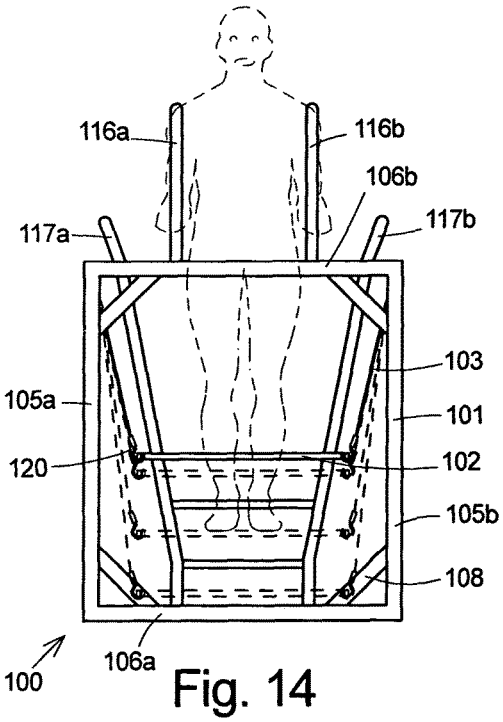
FIG. 14 is a front elevational view of a fifth rebound training device embodying the principles of the invention.

In FIGS. 14-16, a fifth embodiment of a rebound training device, generally designated 100, is seen to include a frame structure, generally designated 101, a footboard 102, and a plurality of resilient elements, collectively designated 103, suspending the footboard 102 from the frame structure 101. Herein, the frame structure 101 includes tubular, rectangular side frames 105*a* and 105*b* connected by upper and lower cross members 106*a* and 106*b*. Corner braces, collectively designated 108, or gussets, are fixed at the corners of the frame structure 101 to minimize racking and provide structural rigidity. Herein, the side frames 105*a* and 105*b* are formed from 2-inch square tube. The frame structure 101, excluding the cross member, handlebars and step, is approximately 42 inches wide, 42 inches long and 48 inches high.

Mounted within the frame structure are a series hand grip members that include a cross member 110 and a pair of spaced side rails 111*a* and 111*b* extending from the cross member 110 rearwardly to side attachments 112*a* and 112*b* and then converging inwardly and downwardly to a bottom end to steps 115 located at the back of the training device 100. Spaced user front handlebars 116*a* and 116*b* extend upwardly and forwardly from the cross member 110 at an angle of approximately 300 from vertical. User side handlebars 117*a* and 117*b* rearward of the cross member 110 extend upwardly and outwardly from respective side rails 111*a* and 111*b*. The handlebars are formed from 1.5-inch round tube.

As seen in the FIGS. 14-16, the resilient elements 103 include hooks 120 at their respective ends that extend between and engage respective horizontal hanger bars 121*a* and 121*b* located below the upper side frame upper portions and an array of spaced holes, collectively designated 123, along the peripheral edges 125 of the footboard 102. Horizontal placement of the hooks 120 along the hanger bars 121*a* and 121*b* may be maintained by placing optional spacers (not shown) between the individual hooks 120.

Figure 19:
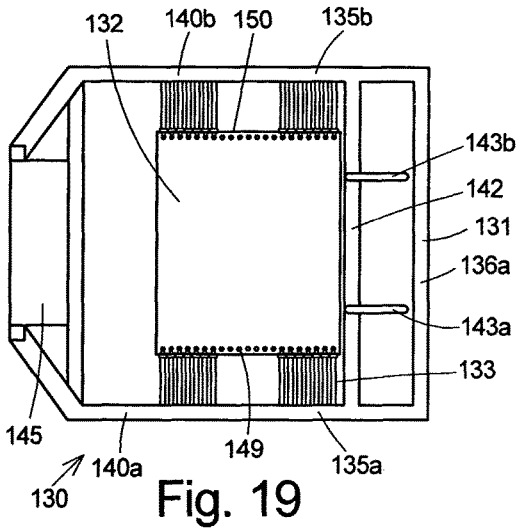
Figure 18:
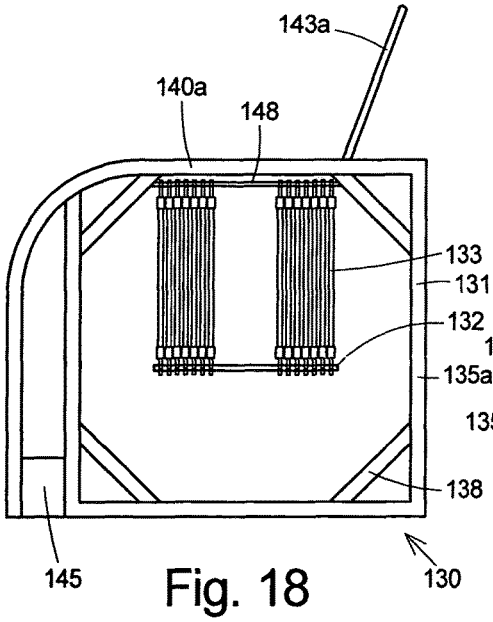
FIG. 18 is a side elevational view of the rebound training device shown in FIG. 17; and, FIG. 19 is a top plan view of the rebound training device shown in FIG. 17.
Figure 17:
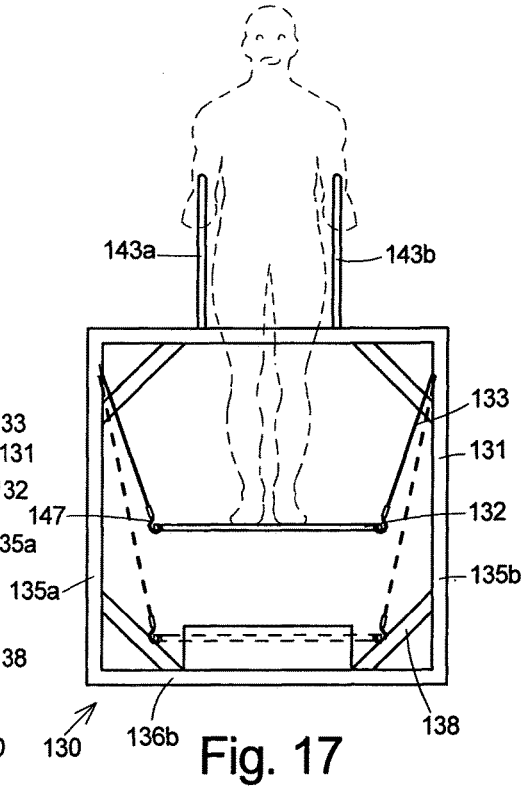
FIG. 17 is a front elevational view of a sixth rebound training device embodying the principles of the invention.

In FIGS. 17-19, a sixth embodiment of a rebound training device, generally designated 130, is seen to include a frame structure, generally designated 131, a footboard 132, and a plurality of resilient elements, collectively designated 133, suspending the footboard 132 from the frame structure 131. Herein, the frame structure 131 includes tubular, rectangular side frames 135*a* and 135*b* connected by upper and lower cross members 136*a* and 136*b*. Corner braces, collectively designated 138, or gussets, are fixed at the corners of the frame structure 131 to minimize racking and provide structural rigidity. Herein, the side frames 135*a* and 135*b* are formed from 2-inch square tube. The frame structure 131, excluding the handlebars and step, is approximately 48 inches wide, 48 inches long and 48 inches high.

Mounted across the top of the frame structure 131 between the top elements 140*a* and 140*b* of respective side frames 135*a* and 135*b* is cross member 142. Spaced user front handlebars 143*a* and 143*b* extend upwardly and forwardly from the cross member 142 at an angle of approximately 30° from vertical. The top elements 140*a* and 140*b* extend rearwardly and then converging inwardly and downwardly to a bottom end at step 145 located at the back of the training device 130.

As seen in the FIGS. 17-19, the resilient elements 133 include hooks 147 at their respective ends that extend between and engage horizontal hanger bars 148 located below respective top elements 140*a* and 141*b* of the side frames 135*a* and 135*b* and respective holes 149 arrayed along the peripheral edges 150 of the footboard 132.

INDUSTRIAL APPLICABILITY

It should be apparent the rebound training device described herein is a simple, functional unit that is effective and easily manufactured.

Other aspects, objects and advantages of this invention can be obtained from a study of the drawings and the disclosure.

It should be understood that the terms "top," "bottom," "upper," "lower," "front," "back," "side," "end," "first," "second," "height," "width," "length," "horizontal," "vertical," and similar terms as used herein, have reference only to the structure shown in the drawings and are utilized only to facilitate describing the invention. The terms and expressions employed herein have been used as terms of description and not of limitation.

From the foregoing, it will be observed that numerous variations and modifications may be effected without departing from the spirit and scope of the invention. It is to be understood that no limitation with respect to the specific apparatus illustrated herein is intended or should be inferred. While specific embodiments of the invention have been disclosed, one of ordinary skill in the art will recognize that one can modify the materials, dimensions and particulars of the embodiments without straying from the inventive concept.

What is claimed is:

1. A rebound training device supported on a floor and operable in response to action of a user standing thereon comprising:

an upright frame having horizontally-extending hanger portions spaced above the floor on either lateral side of the frame and grip portions for the user to grasp, the grip portions being disposed at a forward end of the frame, the frame having an opening between the hanger portions at a rearward end;

a rigid footboard below the hanger portions and having a forward peripheral edge, a rearward peripheral edge spaced from the forward peripheral edge, a pair of spaced lateral peripheral edges connecting the forward peripheral edge and rearward peripheral edge, and a peripheral margin inwardly adjacent the edges, the peripheral margin being circumjacent to a continuous, flat, horizontal upper surface completely spanning the area circumscribed by the margin so as to underlie both feet of a user standing on the upper surface and provide full support under each foot;

a plurality of elongate resilient elements at each lateral side of the frame, each resilient element having a similar length with spaced upper and lower ends, an intermediate length, and a releasable connector hook at each of the ends;

each hanger portion having a horizontal array of least three linearly-aligned connector receiving positions with at least one position disposed intermediate the remaining linearly-aligned hanger portion connector receiving positions;

the footboard having a horizontal array of at least three linearly-aligned connector receiving positions along the margin adjacent each lateral peripheral edge outward from the upper surface with at least one position disposed intermediate the remaining linearly-aligned footboard connector receiving positions, each footboard array generally underlying and parallel to one of the hanger arrays;

a step located at the rearward end whereby a user mounts the footboard through the frame opening;

wherein connector hooks at the resilient element upper ends are connected to the linearly-aligned hanger portion connector receiving positions;

wherein connector hooks at the resilient element lower ends are connected to the linearly-aligned footboard connector receiving positions;

wherein at least three resilient elements may be disposed in horizontally-spaced, side-by-side relation along the margin adjacent each lateral peripheral edge to suspend the footboard from the frame below the hanger portions;

wherein resilient elements may be moved, added or removed to modify spring force; and, wherein the user may extend the resilient elements and effect reciprocal vertical motion of the footboard by applying appropriate force on the upper surface while standing thereon.

2. The rebound training device of claim 1 wherein the footboard connector receiving positions include a horizontal array of holes in the margin and the connector hooks at the lower end of the resilient elements are engageable with the holes.

3. The rebound training device of claim 1 wherein the footboard peripheral edges lie below and inward of the frame hanger portions and are spaced from the frame hanger portions.

4. The rebound training device of claim 1 wherein the hanger portions are zig zag wires extending horizontally in spaced relation on respective lateral sides of the frame.

5. The rebound training device of claim 1 wherein the hanger portions are bars extending horizontally in spaced relation on respective lateral sides of the frame.

6. The rebound training device of claim 5 wherein the hanger connector receiving positions include a horizontal array of holes in the bars and the connector hooks at the upper end of the resilient elements are engageable with the holes.

7. The rebound training device of claim 1 wherein the resilient elements are extension springs.

8. The rebound training device of claim 1 wherein the resilient elements are elastic straps.

9. The rebound training device of claim 1 wherein the grip portions are adjustable to change their position relative to the frame.

10. The rebound training device of claim 1 wherein the grip portions lie above the hanger portions.

11. The rebound training device of claim 1 wherein the footboard is rectangular with adjacent edges being of different length, and wherein the footboard may be rotated 90° about a vertical axis to change the orientation of the footboard.

12. The rebound training device of claim 1 wherein the hanger connector receiving positions include a horizontal array of holes in the hanger portions and the connector hooks at the upper end of the resilient elements are engageable with the holes.

13. The rebound training device of claim 1 wherein the grip portions lie above the hanger portions and are adjustable to change their position relative to the frame.

14. A rebound training device supported on a floor and operable in response to action of a user standing thereon comprising:

an upright frame having horizontally-extending hanger portions spaced above the floor on either lateral side of the frame and grip portions for the user to grasp, the grip portions being disposed above the hanger portions at a forward end of the frame and being adjustable to change their position relative to the frame, the frame having an opening between the hanger portions at a rearward end;

a rigid footboard below the hanger portions and having a forward peripheral edge, a rearward peripheral edge spaced from the forward peripheral edge, a pair of spaced lateral peripheral edges connecting the forward peripheral edge and rearward peripheral edge, and a peripheral margin inwardly adjacent the edges, a horizontal upper surface lying inward of the peripheral margin to underlie both feet of a user standing on the upper surface and provide full support under each foot;

a plurality of elongate resilient elements at each lateral side of the frame, each resilient element having a similar length with spaced upper and lower ends, an intermediate length, and a releasable connector hook at each of the ends;

each hanger portion having a horizontal array of least three connector receiving positions with at least one position of each array disposed intermediate that array's remaining connector receiving positions;

the footboard having a horizontal array of at least three connector receiving positions along the margin adjacent each lateral peripheral edge outward from the upper surface with at least one position of each array disposed intermediate that array's remaining connector receiving positions, each footboard array generally underlying and parallel to one of the hanger portion arrays;

a step at the rear end of the frame for a user to place his foot in elevating himself from the floor through the frame opening onto the upper surface of the footboard;

wherein connector hooks at the resilient element upper ends are connected to hanger portion connector receiving positions;

wherein connector hooks at the resilient element lower ends are connected to the footboard connector receiving positions;

wherein at least three resilient elements may be disposed in horizontally-spaced, side-by-side relation along the margin adjacent each lateral peripheral edge to suspend the footboard from the frame below the hanger portions;

wherein resilient elements may be moved, added or removed to modify spring force; and, wherein the user may extend the resilient elements and effect reciprocal vertical motion of the footboard by applying appropriate force on the upper surface while standing thereon.

15. The rebound training device of claim 14 wherein the grip portions are laterally spaced and independently adjustable.

16. A rebound training device supported on a floor and operable in response to action of a user standing thereon comprising:

an upright frame having horizontally-extending hanger portions spaced above the floor on either lateral side of the frame and laterally-spaced grip portions for the user to grasp, the grip portions being disposed above the hanger portions at a forward end of the frame and being independently adjustable to change their position relative to the frame, the frame having an opening between the hanger portions at a rearward end;

a rigid footboard below the hanger portions and having a forward peripheral edge, a rearward peripheral edge spaced from the forward peripheral edge, a pair of spaced lateral peripheral edges connecting the forward peripheral edge and rearward peripheral edge, and a peripheral margin inwardly adjacent the edges, a horizontal upper surface lying inward of the peripheral margin to underlie both feet of a user standing on the upper surface and provide full support under each foot;

a plurality of extension springs at each lateral side of the frame, each spring having a similar length with spaced upper and lower ends, an intermediate length, and a releasable connector hook at each of the ends;

each hanger portion having a horizontal array of least three holes with at least one hole of each array disposed intermediate that array's remaining holes;

the footboard having a horizontal array of at least three holes along the margin adjacent each lateral peripheral edge outward from the upper surface with at least one hole of each array disposed intermediate that array's remaining holes, each footboard array generally underlying and parallel to one of the hanger portion arrays;

a step at the rear end of the frame for a user to place his foot in elevating himself from the floor through the frame opening onto the upper surface of the footboard;

wherein connector hooks at the spring upper ends are connected to hanger portion holes;

wherein connector hooks at the spring lower ends are connected to the footboard holes;

wherein at least three resilient elements may be disposed in horizontally-spaced, side-by-side relation along the margin adjacent each lateral peripheral edge to suspend the footboard from the frame below the hanger portions;

wherein springs may be moved, added or removed to modify spring force; and, wherein the user may extend the springs and effect reciprocal vertical motion of the footboard by applying appropriate force on the upper surface while standing thereon.

* * * * *